US006409427B1

(12) United States Patent
Maxwell, III

(10) Patent No.: US 6,409,427 B1
(45) Date of Patent: Jun. 25, 2002

(54) SOIL EROSION COLLECTOR

(76) Inventor: Walter S. Maxwell, III, 11000 Tannery Creek Rd., Corning, NY (US) 14830

( * ) Notice: Subject to any disclaimer, the term of this patent is extended or adjusted under 35 U.S.C. 154(b) by 0 days.

(21) Appl. No.: 09/665,801

(22) Filed: Sep. 20, 2000

Related U.S. Application Data

(60) Provisional application No. 60/155,377, filed on Sep. 20, 1999.

(51) Int. Cl.[7] ..... E02B 13/00; E02B 7/00

(52) U.S. Cl. ..... 405/39; 405/108; 405/90; 405/87

(58) Field of Search ..... 405/36, 37, 39, 405/40, 41, 87, 51, 88, 89, 90, 107, 108, 116, 118, 119

(56) References Cited

U.S. PATENT DOCUMENTS 1,028,780 A * 6/1912 Proctor ..... 405/87
1,374,817 A * 4/1921 Bridges et al. ..... 405/90
1,375,240 A * 4/1921 Sullivan ..... 405/90
1,713,605 A * 5/1929 Jones ..... 405/90
2,642,723 A * 6/1953 Reismann ..... 405/90
2,821,842 A * 2/1958 Christiansen ..... 405/90
2,928,251 A * 3/1960 Waring ..... 405/90
3,874,176 A * 4/1975 Shettel ..... 405/93
3,910,052 A * 10/1975 Whitlock ..... 405/51
5,156,489 A * 10/1992 Replogle ..... 405/90
5,921,709 A * 7/1999 Baum et al. ..... 405/114

* cited by examiner

*Primary Examiner*—Heather Shackelford
*Assistant Examiner*—Frederick L. Lagman
(74) *Attorney, Agent, or Firm*—Brown & Michaels, PC

(57) ABSTRACT

A soil erosion collector that fits in a standard two foot drainage ditch. It is preferably formed of pre-cast reinforced concrete. Its purpose is to separate eroded soil in storm run off. The soil Erosion Collector is designed to create a ponding effect, which will slow the flow of water in a ditch, allowing eroded soil and debris to settle. The invention comprises a body with solid intersecting lower sides which meet at an angle to fit into the drainage ditch. A dam connects the sides, with the top of the dam forming a "V" shaped spillway at a lowered central portion.

7 Claims, 4 Drawing Sheets

SOIL EROSION COLLECTOR

REFERENCE TO RELATED APPLICATIONS

This application claims an invention which was disclosed in Provisional Application No. 60/155,377, filed Sep. 20, 1999, entitled "soil Erosion Collector". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of soil collection devices. More particularly, the invention pertains to devices for limiting soil erosion from water running in ditches or the like.

2. Description of Related Art

It is known in the prior art to stake hay bales or burlap cloth in ditches downstream of construction to collect soil and other materials.

SUMMARY OF THE INVENTION

The soil erosion collector of the invention is a structure that fits in a standard two foot drainage ditch. It is preferably formed of pre-cast reinforced concrete. Its purpose is to separate eroded soil in storm run off. The soil Erosion Collector is designed to create a ponding effect, which will slow the flow of water in a ditch, allowing eroded soil and debris to settle.

The invention comprises a body with solid intersecting lower sides or wings which meet a flat floor at an angle to fit into the drainage ditch. A dam connects the sides, with the top of the dam forming a "V" shaped spillway at a lowered central portion.

On low (slower) water flow days, water will pond behind the front spillway and seep through drain holes that are located in the floor of the soil Erosion Collector. On high flow days, the water fills the soil Erosion Collector and spills over the "V". The "V" spillway in the front of the soil Erosion Collector allows water to flow over it, thus allowing the water to remain the center of the ditch. Two concrete punch out plugs are located in the front center of the soil Erosion Collector. These plugs can be opened to allow water to flow through the front spillway with less ponding.

The soil Erosion Collector mold is preferably made of channel iron supports covered with steel plate. The mold base forms the inside shape of the soil Erosion Collector. This includes the floor, wings and front spillway.

DETAILED DESCRIPTION OF THE INVENTION

Figure 1:
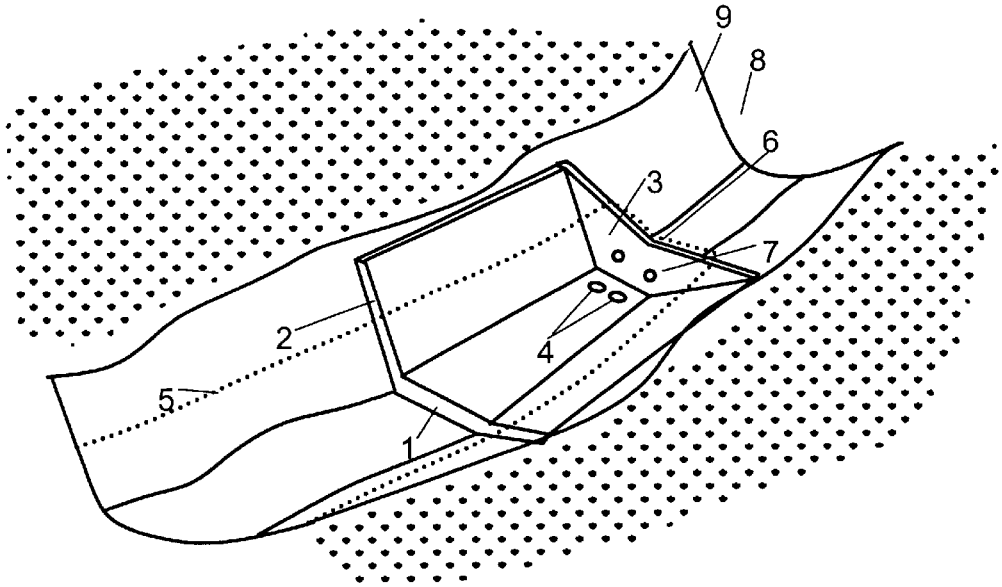
FIG. 1 shows the invention in use.
Figure 2:
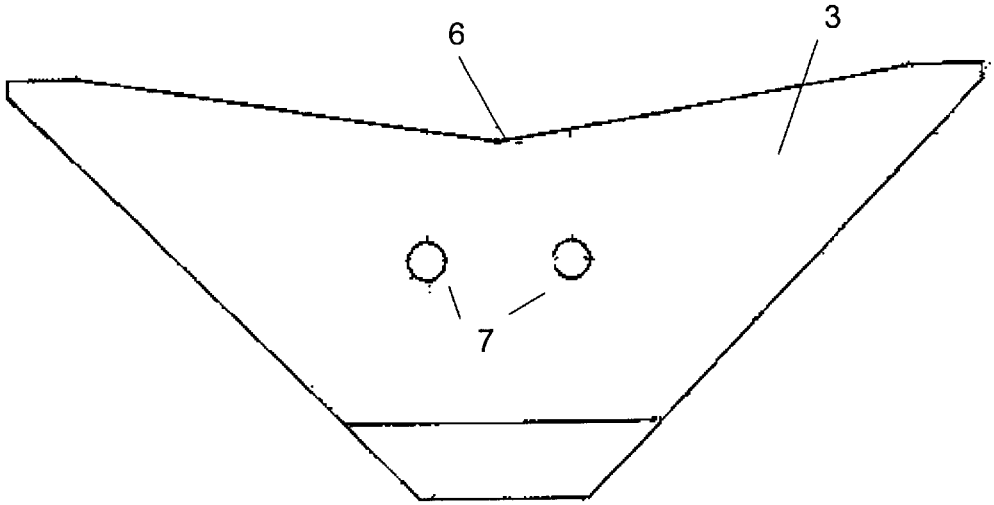
FIG. 2 shows a side view of the wings of the invention.
Figure 3:
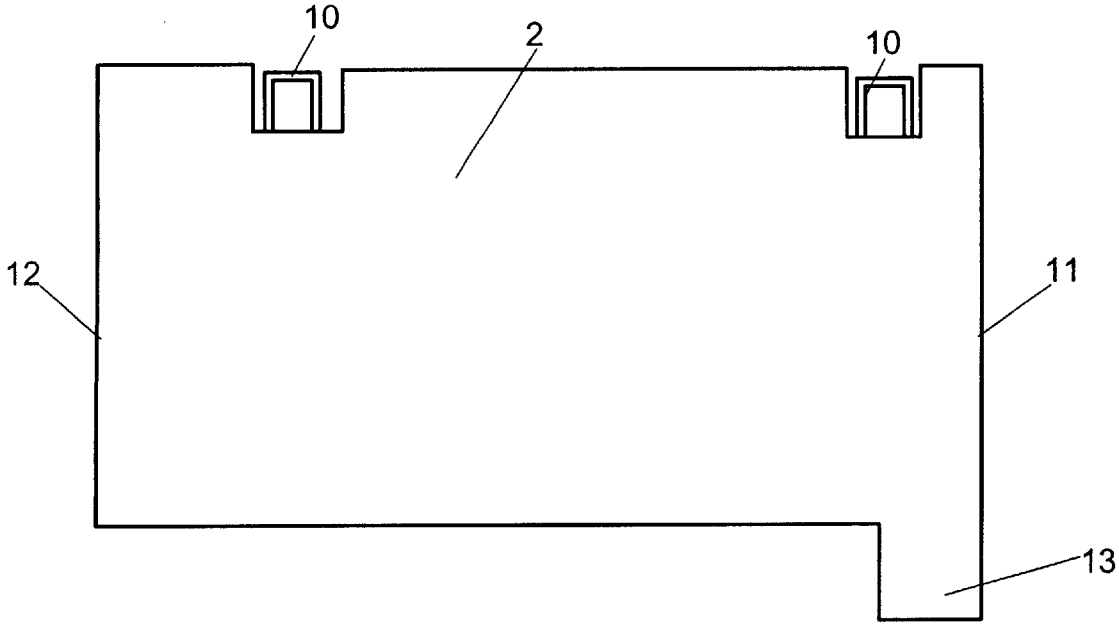
FIG. 3 shows a view of the spillway of the invention.
Figure 4:
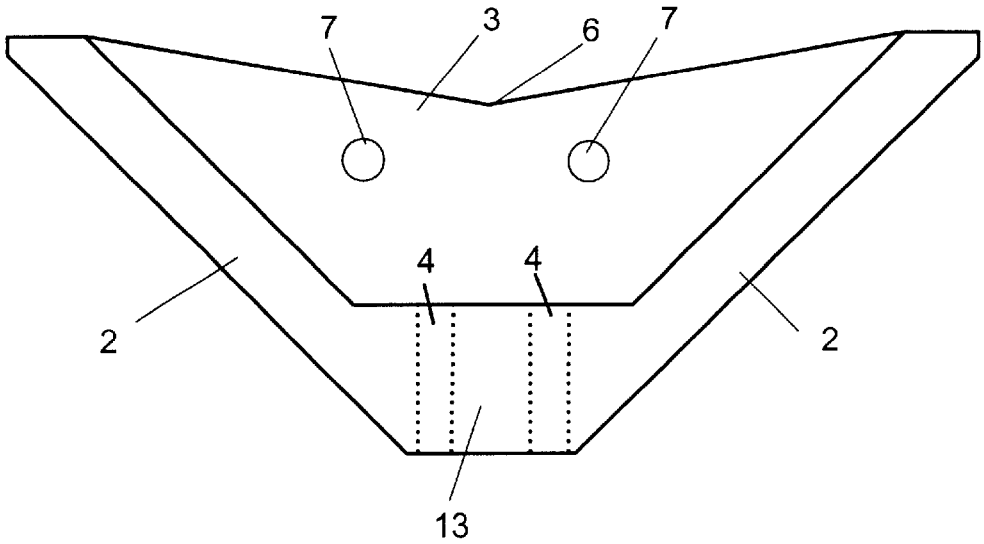
FIG. 4 shows a back view of the invention.
Figure 5:
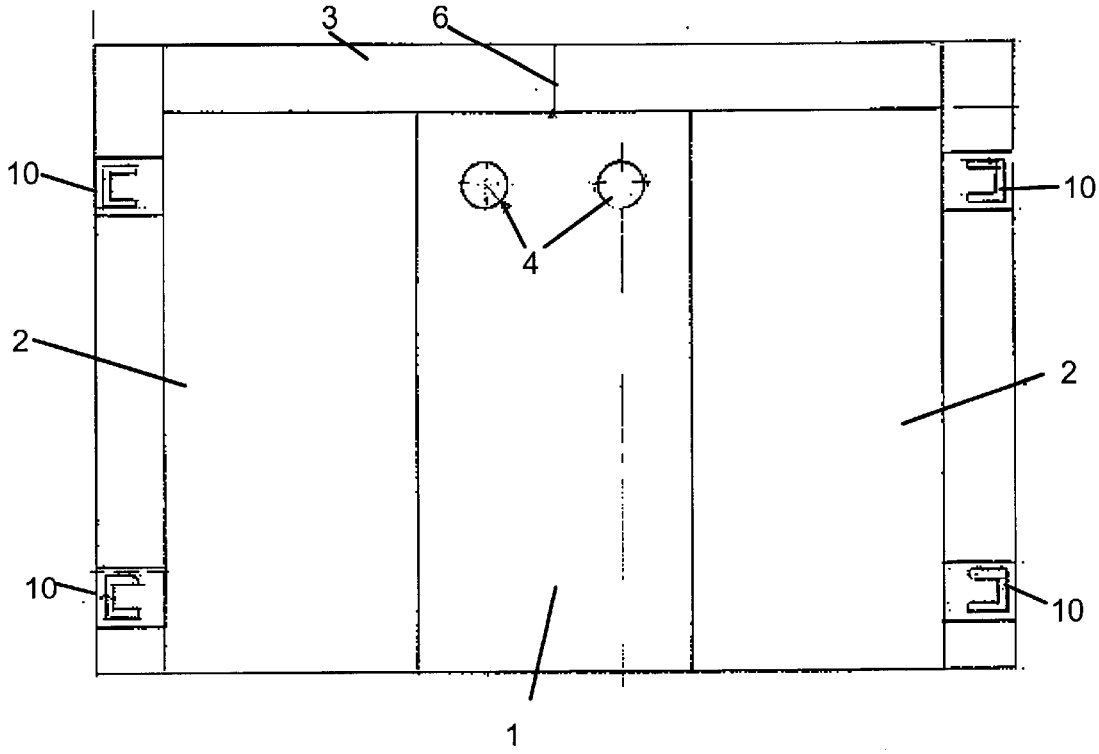
FIG. 5 shows top view of the assembled invention.

The soil erosion collector of the invention is a structure that fits in a standard two foot drainage ditch (8), which has walls (9) which slope at a standard angle (usually 45°, or a "one to one slope"). The collector is preferably constructed of pre-cast reinforced concrete.

Its purpose is to separate eroded soil in storm run off. The soil erosion collector is designed to create a ponding effect, which will slow the flow of water (5) in a ditch (8), allowing eroded soil and debris to settle.

On low (slower) water flow days, water will pond behind the front dam (3) and seep through drain holes (4) that are located in the floor (1) of the soil erosion collector. On high flow days, the water fills the soil erosion collector and spills over the "V" spillway (6) on top of the dam. The "V" spillway (6) in the darn on the downstream end of the soil erosion collector allows water to flow over it, thus allowing the water (5) to remain in the center of the ditch (8). Two concrete punch out plugs (7) are located in holes in the dam (3) of the soil erosion collector. These plugs can be opened to allow water to flow through the dam (3) with less ponding.

Figure 6:
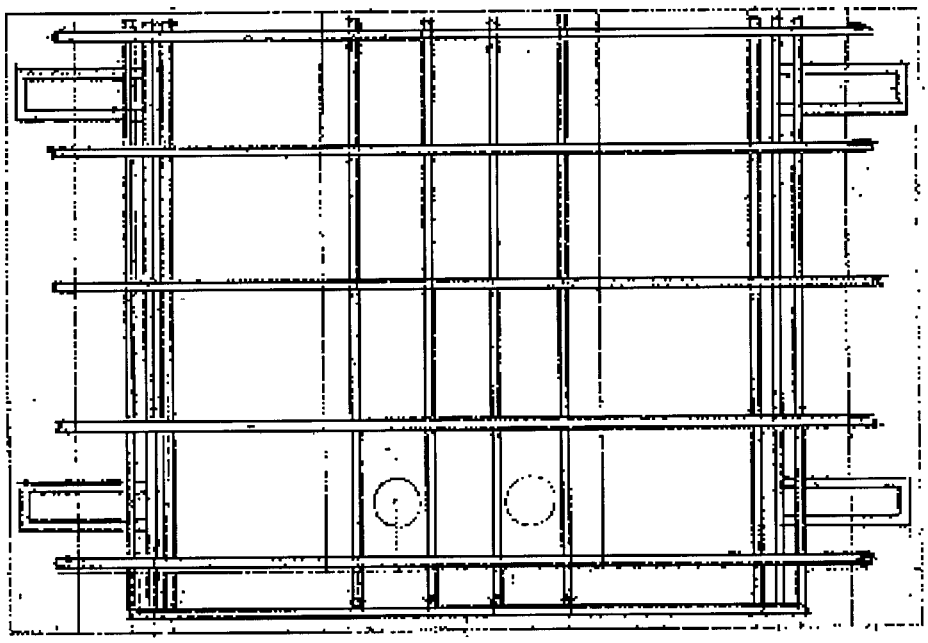
FIG. 6 shows a top view of the rebar cage of the invention.
Figure 7:
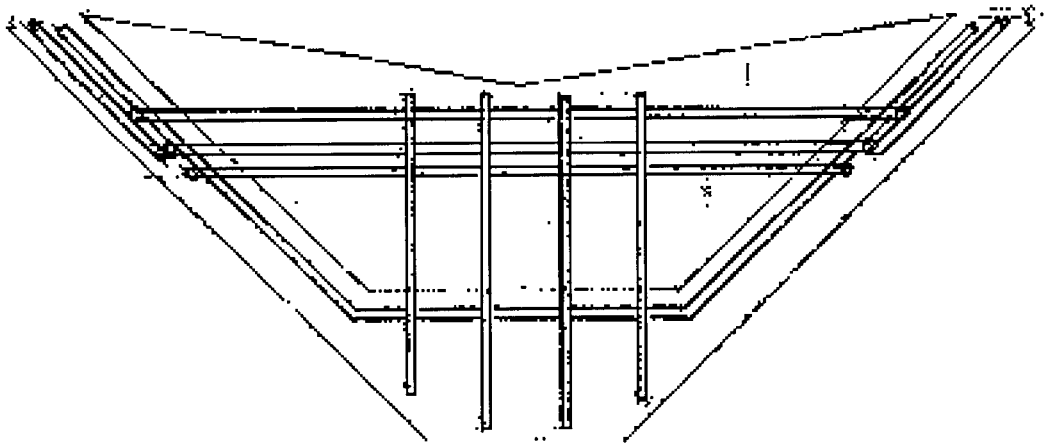
FIG. 7 shows an end view of the rebar cage of the invention.

Referring to FIGS. 6 and 7, the soil erosion collector is made of ⅝ inch diameter concrete rebar that is welded together, forming a rebar cage. The rebar wing bars, (which run side to side), where each wing has an upstream (11) and downstream end (12), are welded to the floor bars (which run from the dam along the floor and down to the toe). Hoop bars are then welded over the wing bars on each side and over the floor bar in the dam. After the cage is welded, pick hoops are welded on each corner for picking and placing the soil erosion collector.

The soil erosion collector mold is preferably made of channel iron supports covered with steel plate. The mold base forms the inside shape of the soil erosion collector. This includes the floor (1), wings (2) and dam (3) with its spillway (6).

The rebar cage is placed on the mold with spacers so correct distance is obtained. This allows the cage to be suspended when concrete is poured. The floor hole inserts are placed on mold base. Styrofoam blocks are fit around the pick hoops. The outside of the mold is then folded into place. Eight 32" steel wire pieces are placed from wing flap to wing bar and back up to mold flaps. This suspends the wire cage, holding it into place for the pouring of concrete. After wires are in place, the spacers are removed. Then, front plug inserts are put into place. The front of the mold is then fastened to the wing flaps and the front "V" at the base of the mold.

The concrete mixture, preferably a 4000 psi commercial mix with #1 aggregate, can then be poured into the mold to form the collector of the invention. At the time of the pour, a small amount of concrete is poured into the mold. Then, with a vibrator, cement is worked down along the mold. This procedure is repeated until the mold is full.

Installation is easy using a template in the shape of the soil erosion collector wings and floor. The ditch is sloped at 1 to 1 grade. Excavating a 2½ ft. wide by 6 to 8 in. deep trench at the bottom of the ditch. Fill with #3 or #6 stone 6–8 inches deep. Let this trench open at a grade in the ditch below where the soil erosion collector is placed.

The front 18" to 24" of the soil erosion collector site on a bed of washed stone approximately 6" deep. This allows water behind the spillway (water inside the soil erosion collector) to seep through the holes of the soil erosion collector, down through the stone, and flow down the ditch. The soil erosion collector "toe" (13), located below the floor, at the back, keeps water that flows down the ditch so it does not move/slide down the ditch.

The soil erosion collector is picked, moved and placed by inserting chains through "pick hoops" (10) that are part of the cage at the top of the soil erosion collector on each corner of the wings (2).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A soil erosion collector for collecting soil in a ditch having walls, comprising a unitary concrete body comprising:

a) a flat rectangular floor having an upstream end, a downstream end, and two sides, the floor having a plurality of drain holes;

b) two rectangular wings, each wing having an upstream end and a downstream end, an upper side and a lower side, the upper and lower sides of the wings being equal in size to the sides of the floor; the lower side of each wing being mounted to a side of the floor, such that the wings meet the floor at an angle chosen such that the wings fit against the walls of the ditch;

c) a dam having a lower portion fitting against the downstream end of the floor, side portions fitting against the downstream ends of the two wings, and a spillway portion connecting the downstream ends of the upper sides of the wings; and d) a toe located below the floor, at the upstream end of the two wings.

2. The soil erosion collector of claim 1, in which the spillway portion of the dam has a lower central area, such the spillway forms a central "v".

3. The soil erosion collector of claim 1, in which the dam has a plurality of drain holes.

4. The soil erosion collector of claim 3, further comprising a plurality of punch-out plugs fitting in the drain holes in the dam.

5. The soil erosion collector of claim 1, further comprising a plurality of pick hoops on the upper sides of the wings.

6. The soil erosion collector of claim 1, in which the floor, sides and spillway are formed of reinforced concrete.

7. The soil erosion collector of claim 1, in which the wings meet the floor at an angle of approximately 135 degrees.

* * * * *